US005255005A

United States Patent [19]

Terret et al.

[11] Patent Number: 5,255,005

[45] Date of Patent: Oct. 19, 1993

[54] DUAL LAYER RESONANT QUADRIFILAR HELIX ANTENNA

[75] Inventors: Claude Terret; Ala Sharatha, both of Rennes; Léonid Aupy, Cesson Sevigne, all of France

[73] Assignee: L'Etat Francais Represente par LeMinistre des Pastes Telecommunications et de l'Espace, France

[21] Appl. No.: 609,383

[22] Filed: Nov. 5, 1990

[30] Foreign Application Priority Data

Nov. 10, 1989 [FR] France ..... 89 14952

[51] Int. Cl.[5] ..... H01Q 1/36; H01Q 21/20

[52] U.S. Cl. ..... 343/895; 343/850

[58] Field of Search ..... 343/895, 908, 796, 850, 343/853, 858

[56] References Cited

U.S. PATENT DOCUMENTS

| | | | |
|---|---|---|---|
| 3,906,509 | 9/1975 | DuHamel | 343/895 |
| 4,148,030 | 4/1979 | Foldes | 343/895 |
| 4,554,554 | 11/1985 | Olesen et al. | 343/895 |

FOREIGN PATENT DOCUMENTS

| | | | |
|---|---|---|---|
| 0169823 | 1/1986 | European Pat. Off. . | |
| 0320404 | 6/1989 | European Pat. Off. . | |
| 0098705 | 6/1985 | Japan | 343/895 |

OTHER PUBLICATIONS

Kilgus, "Resonant Quadrifilar Helix Design", The Microwave Journal, Dec. 1970, pp. 49-54.

UHF Satellite Array Nulls Adjacent Signals, Microwaves & RF, Mar. 1984 by J. L. Wong, et al.

K. M. Keen, "Developing a Standard-C Antenna", MSN & Ct., Jun., 1988.

J. Huang, et al., "L-Band Satellite Communication Antennas for U.S. Coast Guard Boats, Land Vehicles, and Aircraft", IEEE Ap-J Int. Symp. Digest, 1987.

*Primary Examiner*—Rolf Hille

*Assistant Examiner*—Hoanganh Le

*Attorney, Agent, or Firm*—Locke Reynolds

[57] ABSTRACT

Disclosed is a new antenna structure having a quasi-hemispherical radiation pattern and capable of having a relatively wide passband, so that it is possible to define two neighboring transmission sub-bands therein or, again, a single wide transmission band. The antenna is of the type comprising a quadrifilar helix (11) formed by two bifilar helices ($11_1$, $11_2$, $11_3$, $11_4$) positioned orthogonally and excited in phase quadrature, and including at least one second quadrifilar helix that is coaxial and electromagnetically coupled with said first quadrifilar helix (11). Preferred application to L band communications among geostationary satellites or transiting satellites with moving bodies fitted out with such antennas.

15 Claims, 4 Drawing Sheets

1/4

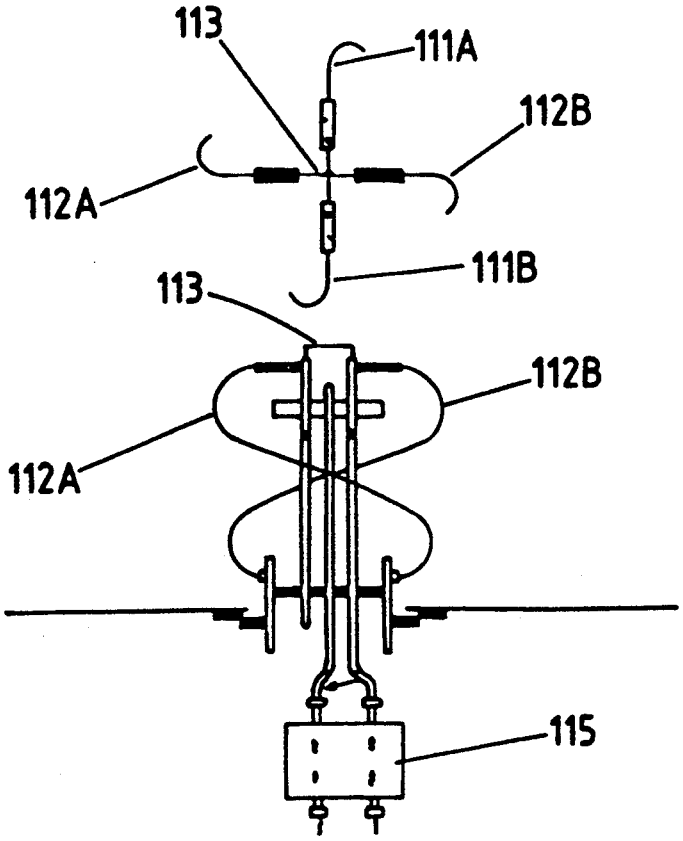
Fig. 11A
PRIOR ART
Fig. 11B
PRIOR ART
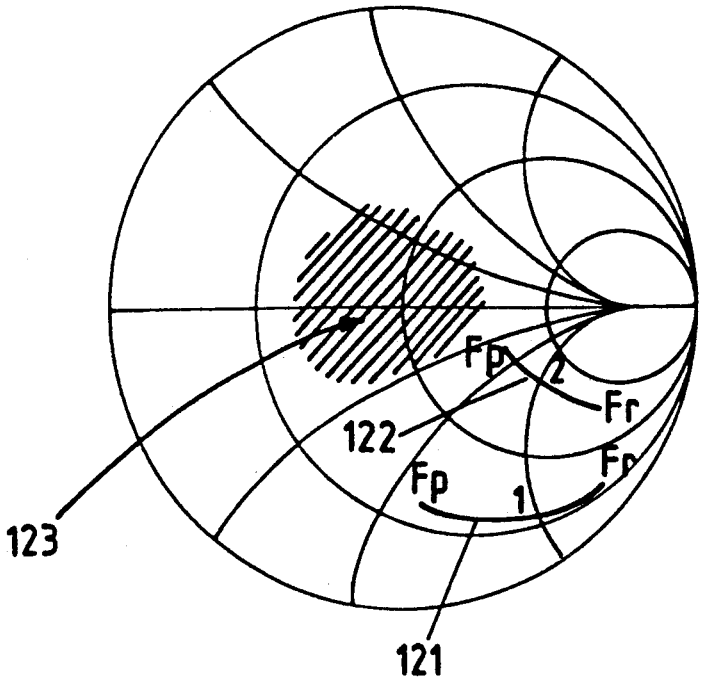
Fig. 12
PRIOR ART

DUAL LAYER RESONANT QUADRIFILAR HELIX ANTENNA

BACKGROUND OF THE INVENTION

1. Field of the Invention

The present invention concerns a novel antenna structure, that has a quasi-hemispherical radiation pattern, and is capable of having a relatively wide passband, so as to make it possible, for example, to define two neighboring sub-bands therein.

This type of antenna can be applied, for example, in the context of satellite communications between fixed users and aeronautical, naval and land-based moving bodies. In this field, several satellite communications systems have been undergoing development in L band (for example INMARSAT, MSAT, PROSAT, NAVSTAR, G.P.S. etc.).

The first three systems referred to correspond to links with geostationary satellites. In these systems, the specifications of the antennas designed to fit out the moving bodies make it necessary for these antennas to have a radiation pattern with a quasi-hemispherical coverage, owing to very different incidences and or major variations in incidence of the received or transmitted signals.

Furthermore, the polarization of the antennas should be circular with an ellipticity of more than 5 dB (20 dB isolation) and special attention has to be paid to combating multiple-path phenomena for air and land-based moving bodies. This latter specification, moreover, makes it necessary for the preponderant component of the electrical field to be vertical for low elevations.

As for antennas which can be used at the reception of signals by transiting satellites used in systems of the U.S. NAVSTAR type, the specifications lay down that they should be operational in a passband of about 10% or in two neighboring sub-bands.

2. Description of the Prior Art

In the present state of the art, the only antenna structure compatible with this type of specification (essentially a quasi-hemispherical radiation pattern and circular polarization) is the resonant quadrifilar helix.

This type of known antenna, as shown in FIGS. 11A, 11B, is formed by two bifilar helices 111, 112, positioned orthogonally and excited in phase quadrature.

The exemplary structure shown in FIGS. 11A, 11B is cited in the work "UHF Satellite Array Nulls Adjacent Signals", Microwave & R.F., March 1984.

The antenna is the resonant quadrifilar helix with wires 111A, 111B; 112A, 112B short-circuited at their non-excited end 113. The passband is in the range of 10% with a 140% aperture at −3 DB for a wire length equal to $\lambda_o/2$ and a helical winding on a half turn. This type of antenna must not be mistaken for certain helical antennas of the type disclosed, for example, in the patent document U.S. Pat. No. 4,148,030 (FOLDES), the purpose of which is to provide highly directional (not quasi-hemispherical as in the invention) and high-gain axial radiation patterns. Their operation is of the travelling wave type, and they do not work in resonant mode. Moreover, these known antennas have a different structure. They have, in particular, a length that is several times the operating wavelength $\lambda$ of the antenna. Besides, each helical wire is made of a plurality of resonating dipoles, to work at a specific frequency.

There is also another known embodiment of a quadrifilar helical antenna, used in INMARSAT STANDARD-C satellite communications between moving bodies, where the antenna must work accurately in two sub-bands (1530–1545 MHz) and (1631.5–1646.5 MHz) corresponding respectively to reception and transmission (K. M. KEEN "Developing a Standard-C Antenna", M.S.N. Communications Technology, June 1988).

In this known embodiment, the antenna is a resonant quadrifilar helix with printed wires open at their non-excited end.

Although the resonant quadrifilar antennas meet the requisite specifications, they have a number of drawbacks.

The main problems posed by this known type of structure relate to the constraints of matching the impedance values of the antenna with those of the coaxial feed lines while, at the same time, achieving adequate excitation of the orthogonal bifilar helices.

In the narrow band systems, the feed/matching module may be positioned externally to the antenna, around the working frequency. But, when the antenna has to work in a wideband, as discussed herein, a feed/matching antenna internal to the antenna structure is generally used. The most common one is the so-called "balun" (sometimes also called a "symmetrizer") system or its variant, the "folded balun" with dissymmetrical input and symmetrical output.

An assembly such as this is shown in FIG. 11 where, taking account of the excitation and symmetry of structure of the antenna, the two orthogonal helices 111 and 112 have the same input impedance. Each bifilar helix 111A, 111B; 112A, 112B is fed by a folded balun type of coaxial symmetrizer. The two bifilars are then excited in phase quadrature by means of a hybrid coupler 115 (90°, −3 DB). Each coaxial (dissymmetrical) input therefore sees, in parallel, the impedance of the bifilar helix and a length adapter in the neighborhood of $\lambda/4$.

The symmetrizer/adapter assembly used in this type of antenna is made, for example, by means of a coaxial section with a length $\lambda/4$, the core and sheath of which form a dipole. To circumvent the problems due to the radiation from the sheath, the dipole may be enclosed between the core and an additional coaxial sheath (bazooka system) so as to prevent the flow of a current on the sheath of the coaxial line.

However, this type of assembly has the drawback of forming a sort of passband filter with a band that is still too narrow.

More complex systems were then conceived of, using a line compensated for by means of a solid conductor or, again, a dead coaxial cable forming a trap circuit (see C. C. Kilgus, "Resonant Quadrifilar Helix", Microwave Journal, December 1970).

In any case, a matching device must be added between the hybrid coupler and the "baluns" to match the antenna. This emerges clearly, in particular from the Smith pattern in FIG. 12 where it is clearly seen that, for two embodiments, the operating windows 121, 122 are essentially outside the matching zone 123.

Now, the use of matching devices introduces losses and often restricts the band of use of the antenna. Furthermore, in these exemplary embodiments, and certainly for reasons related to the space factor, the "folded balun" is placed in the very body of the antenna excited at its upper end. This then produces a disturbance by diffraction of the radiation patterns, particularly at the high frequencies.

It is an object of the invention to overcome these drawbacks.

More precisely, the invention provides a new antenna structure with an almost hemispherical radiation pattern and with circular polarization, notably (but not exclusively) in L Band.

Another aim of the invention is to provide a structure such as this, that avoids the need for introducing complex matching means between the antenna and its excitation.

It is also an aim of the invention to provide an antenna with a widening of the passband, or a dual frequency operation, notably either in a passband $\approx 10\%$ or in two neighboring passbands.

An additional object of the invention is to give a low-cost antenna with energy consumption compatible with the constraints of systems on board land-based, sea, air or space craft.

These aims, as well as others that shall appear here below, are achieved according to the invention by means of a resonant helical antenna with quasi-hemispherical radiation, of the type having a quadrifilar helix, formed by two bifilar helices arranged orthogonally and excited in phase quadrature, said antenna having at least one second quadrifilar helix that is coaxial and electromagnetically coupled with said first quadrifilar helix, each of said quadrifilar helices being wound around a distinct cylinder, with a constant radius.

The overlapping of these two resonant quadrifilar helices makes it possible to obtain a quasi-hemispherical radiation pattern over a wide frequency band, or over two neighboring frequency bands, depending on the settings chosen for their electromagnetic coupling.

Advantageously, the length of the wires is smaller than the wavelength $\lambda$ of operation of said antenna, and is preferably between $\lambda/2$ and $\lambda$, so as to obtain the desired hemispherical pattern, with operation in standing wave mode.

According to a preferred characteristic of the invention, the wires of said second quadrifilar helix are in a position of precise or near radial overlapping, with the wires of said first quadrifilar helix.

According to another characteristic of the invention, said coupled quadrifilar helices are connected in parallel to a common feeder. Advantageously, said common feeder includes, firstly, a coupler element for the excitation, in phase quadrature, of the two orthogonal bifilar helices of each quadrifilar helix and, secondly, a symmetrizer element for the feeding, in phase opposition, of each of the wires of the bifilar helices.

Preferably, the wires of at least one of the two quadrifilar helices are open or short-circuited at their non-excited end.

Advantageously, at least one of the quadrifilar helices is made by means of printed circuit technology on dielectric support.

According to an advantageous characteristic of the invention, the coupling of said quadrifilar helices is controlled through at least one of the following means:

- checking of the radial divergence of overlapping of said quadrifilar helices;
- checking of the angular offset between said quadrifilar helices;
- checking of the helix pitch of each of said helices, in particular so as to match the impedance presented by each wire.

According to a first embodiment, said coupling of said quadrifilar helices is done so as to obtain a radiation of the antenna in a single wide passband.

According to a second embodiment, said coupling of said quadrifilar helices is done so as to obtain a radiation of the antenna in at least two passbands that are apart.

It is clear that, through the invention, the checking of the coupling can be optimized, without lowering any of the other characteristics of the antenna, and in particular the circular polarization and the radiation pattern.

BRIEF DESCRIPTION OF THE DRAWINGS

Other characteristics and advantages of the invention will appear from the following description of a preferred embodiment given as a non-restrictive illustration, and from the appended drawings wherein:

FIGS. 11A, 11B and 12 respectively illustrate a front and top view and the Smith pattern of the impedance curve of a known type of monolayer quadrifilar helix.

DESCRIPTION OF PREFERRED EMBODIMENTS

Figure 1:
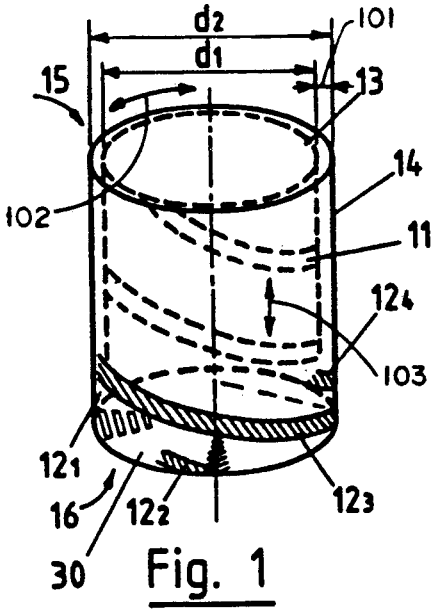
FIG. 1 is a view in perspective of an advantageous embodiment of a double helix quadrifilar antenna structure according to the invention.

A preferred embodiment of the antenna structure of the invention is shown in FIG. 1. It is formed by two concentric quadrifilar helices 11 and 12, wound around coaxial cylindrical insulator supports 13 and 14, with distinct diameters $d_1$, $d_2$. Clearly, the antenna structure of the invention can be extended to more than two concentric quadrifilar helices, in an obvious way. Each quadrifilar helix 11 and 12 has four wires $\mathbf{11}_1$, $\mathbf{11}_2$, $\mathbf{11}_3$, $\mathbf{11}_4$ and $\mathbf{12}_1$, $\mathbf{12}_2$, $\mathbf{12}_3$, $\mathbf{12}_4$ respectively, evenly spaced out and wound on the cylindrical supports 13, 14.

Figure 2:
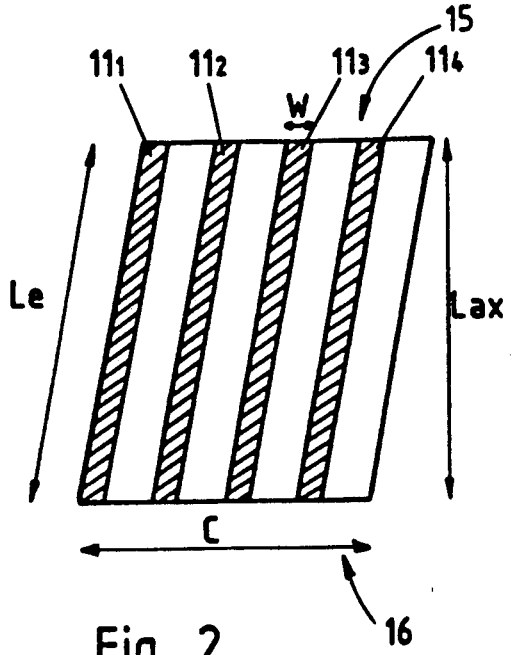
FIG. 2 is a spread out view of one of the two overlapping quadrifilar helices, made in the form of printed copper strips on a kapton substrate.

Each wire $\mathbf{11}_1$, $\mathbf{11}_2$, $\mathbf{11}_3$, $\mathbf{11}_4$; $\mathbf{12}_1$, $\mathbf{12}_2$, $\mathbf{12}_3$, $\mathbf{12}_4$ is formed by a continuous strip of electrically conductive material such as copper, with a width W, printed on a Kapton substrate, as shown in FIG. 2. The Kapton substrate may have a thickness of 50 $\mu$m for a copper strip width W of 35 $\mu$m.

The length of each wire is advantageously between $\lambda/2$ and $\lambda$ and is, in any case, smaller than or equal to $\lambda$, so as to work in resonant mode and obtain a quasi-hemispherical radiation pattern.

When the wires have a length slightly higher than $\lambda$, a radial radiation pattern is obtained, and not a quasi-hemispherical one. This kind of pattern can however appear interesting, in some particular applications.

Figure 3:
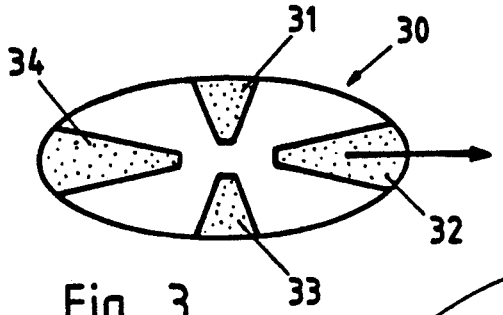
FIG. 3 is a plane view of the base of the supporting cylinders of the antenna of FIGS. 1 and 2, bearing conductive connection segments of the radiating wires.

The four wires of each helix 11, 12 are open at each end 15 (upper end in FIGS. 1 and 2) and electrically connected to the other end 16 (lower end in FIGS. 1 and 2) with conductive segments 31, 32, 33, 34 positioned on the base 30 of the lower part 16 of the cylindrical supports 13, 14 as shown schematically in FIG. 3. These plane segments 31, 32, 33, 34 are advantageously formed by strips printed on Kapton, in the form of portions of segments with decreasing width from the edge up to the vicinity of the center of the base 30 of the cylinders 13, 14. Each of these conductive segments is connected to the central core of one of the four 50Ω feeder coaxial cables of the antenna structure. The two quadrifilar helices 11, 12 are thus parallel fed, wire to wire ($11_1$, $12_1$; $11_2$, $12_2$; $11_3$, $12_3$; $11_4$; $12_4$).

Figure 4:
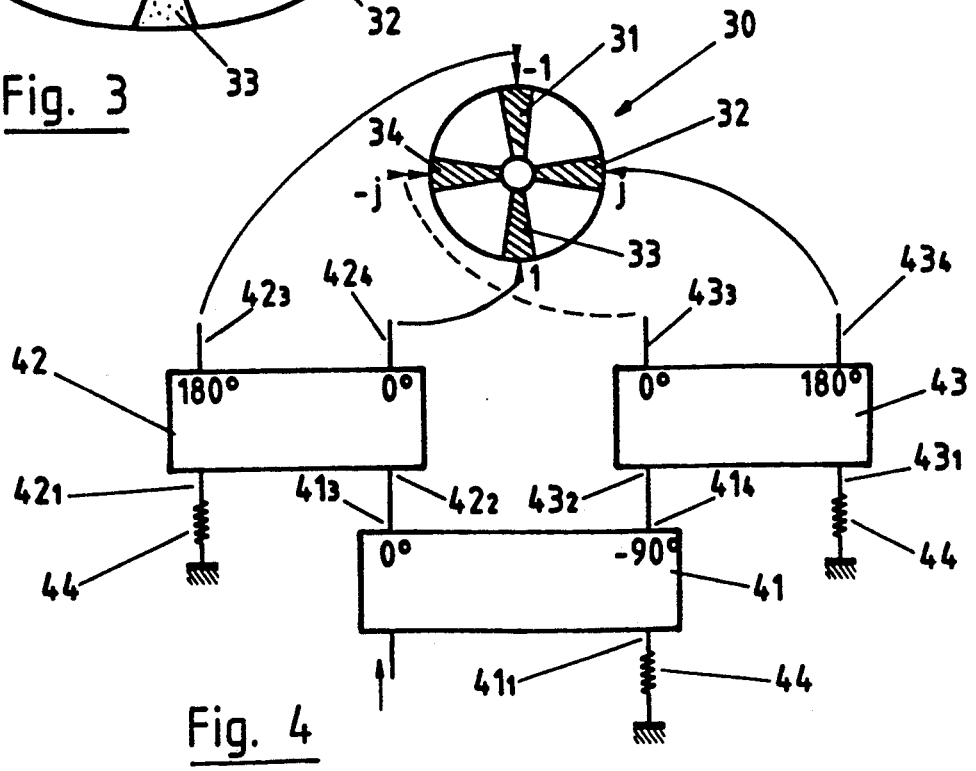
FIG. 4 gives a schematic view of a standard feeder structure for the antenna of FIGS. 1 to 3.

The four wires of each helix 11, 12 are excited through the segments 31, 32, 33, 34 according to the feeder configuration shown schematically in FIG. 4, by means of a standard device formed by a hybrid coupler module 41 (3 dB, 90°) and two symmetrizer modules, 42, 43 (3 dB, 180°). One of the inputs, $41_1$, $42_2$, $43_3$, of each of these modules 41, 42, 43 is connected to the ground through a 50Ω resistor 44. The coupler module 41 is positioned so that the two outputs $41_3$, $42_4$ feed the other input $42_2$, $43_3$ of the two modules 42, 43. The outputs at 180°, $42_3$, $42_4$ of the symmetrizers are connected so as to feed two segments 31, 34, the outputs at 0°, $42_4$ and $43_3$ exciting the other two segments 33, 34. In this way, we obtain an excitation in phase quadrature of the two bifilar helices 31, 33 and 32, 34 of each quadrifilar helix 11, 12 and an excitation in phase opposition of each of the wires 31 and 33, on the one hand, and 32 and 34, on the other hand, of each bifilar helix.

This assembly may be made compactly by means of printed technology, and may be placed directly at the base of the antenna structure.

In view of the value, close to 50Ω of the input impedance of each of the wires of the dual quadrifilar helical structure, no additional impedance matching is necessary.

Clearly, other configurations may be envisaged, as well as other technical means of implementation, as will be seen by those skilled in the art. Thus, in another embodiment of the excitation of the antenna structure (not shown) it is possible not to feed one of the two quadrifilar helices, which would then work as a stray element with respect to the second one.

The control of the coupling between the two quadrifilar helices can be done in many ways. It is notably possible to act on the radial divergence between the two helices, on the angular shift of the antennas around the axis of revolution of the antenna, with respect to a position of exact radial wire-to-wire overlapping, or again on the helix pitch of each of the helices.

The electromagnetic coupling of each impedance matched antenna wire, for example at 50Ω, is of course controlled so as not to damage, or so as to cause the least possible damage to, the other characteristics of the antenna, notably the circular polarization and the radiation pattern.

Figure 8:
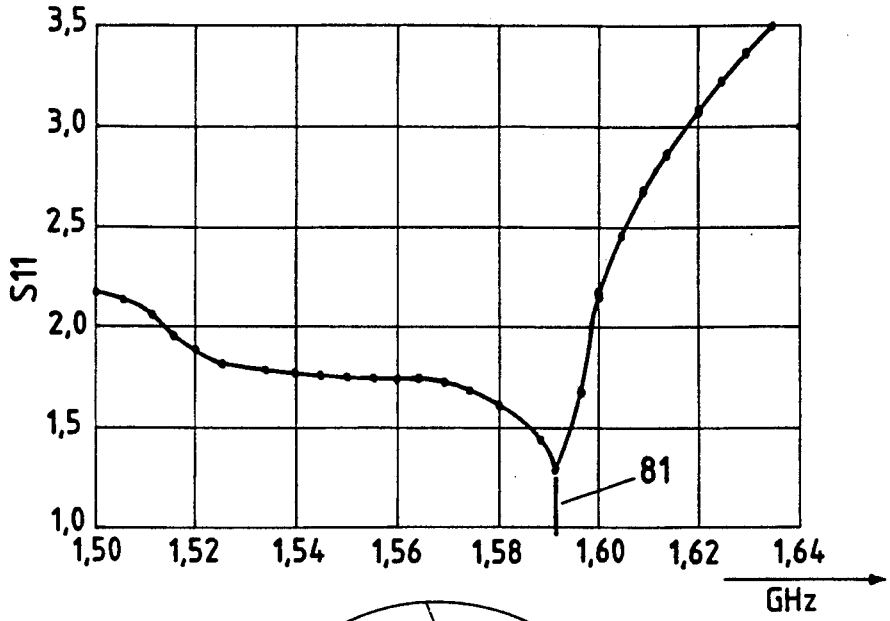
FIGS. 8, 9, 10 respectively represent the SMITH pattern, the value of the SWR and the radiation pattern in copolar and counterpolar circular polarization of a prototype of the invention dimensioned for wideband operation.
Figure 9:
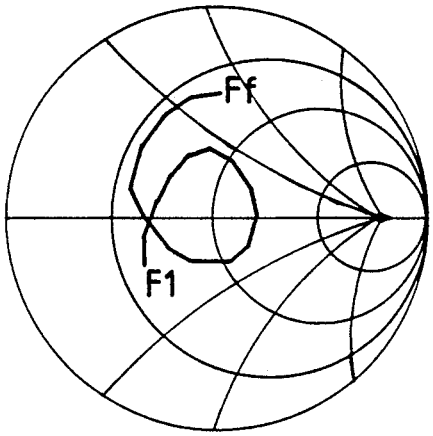
Figure 10:
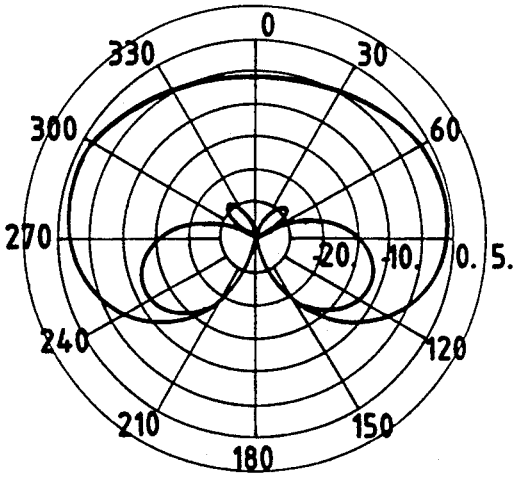

We shall now present the results obtained with two prototypes for implementing the antenna structure of the invention, corresponding respectively to a dual band configuration (FIG. 5, 6, 7) and to a wideband configuration (FIGS. 8, 9, 10).

Dual Frequency (or Dual Band) Antenna

In the first embodiment computed and tested, the antenna parameters are presented in the table I (with C: circumference; Le: length of a radiating wire; Lax: axial length; with reference to the notations of FIG. 2)

TABLE I

| | internal helix | external helix |
|---|---|---|
| C | 0.5 λo | 0.57 λo |
| Le | 0.74 λo | 0.76 λo |
| Lax | 0.58 λo | 0.59 λo |

A series of measurement readings was taken on each helix taken separately, then in simultaneous parallel feeding. Here below, the impedance presented is the impedance computed at the input of a radiating wire of the helix in the presence of the other ones, this impedance being half of that of a bifilary helix.

In the case of the measurements of the quadrifilar antennas taken separately, a reading was taken of a passband for a SWR<2 equal to 60 Mhz (internal antenna) and to 50 Mhz (external antenna).

Figure 5:
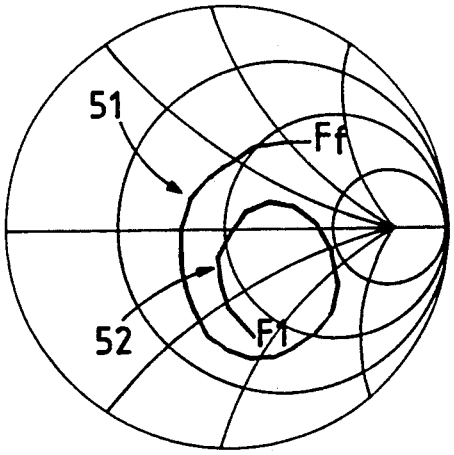
FIGS. 5, 6, 7 respectively represent the SMITH pattern, the value of the SWR and the radiation pattern in copolar and counterpolar circular polarization of a prototype of the invention dimensioned for dual band operation (dual frequency antenna).
Figure 6:
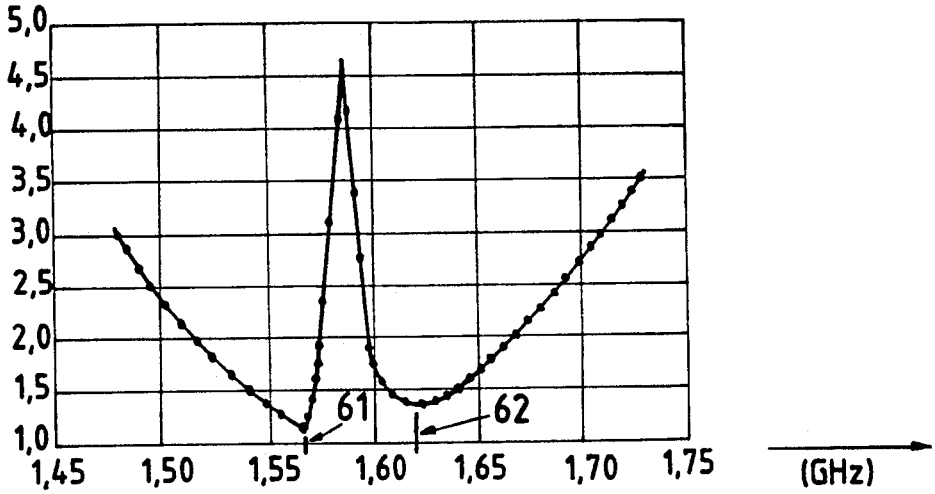

The parallel feeding of the two helices leads to the impedance curve of the SMITH pattern of FIG. 5, where the curve represented for F1=1,480 to Ff=1,730 has two frequency bands 51, 52 that are apart in the matching region of the antenna. It is moreover possible, by means of an impedance transformer, to recenter the impedance curve on the chart. An adapted dimensioning of the parameter of the antenna also makes it possible to obtain a coincidence of the portions 51 and 52. The curve marks a double resonance owing to the coupling between the two quadrifilars. As can be seen in the SWR pattern of FIG. 6, the assembly works like two coupled resonant circuits, the coupling of which deflects the resonance frequencies 61, 62. The SWR is below 1.5 in two distinct frequency bands: 1.54 GHz<f<1.5666 Ghz and 1.602 Ghz<f<1.64 Ghz.

Furthermore, since the antenna is practically matched at 50Ω around the two resonance frequencies, the excitation device does not necessitate any specific assembly for additional matching. This frees the antenna from the drawbacks of the simple quadrifilar antenna.

Figure 7:
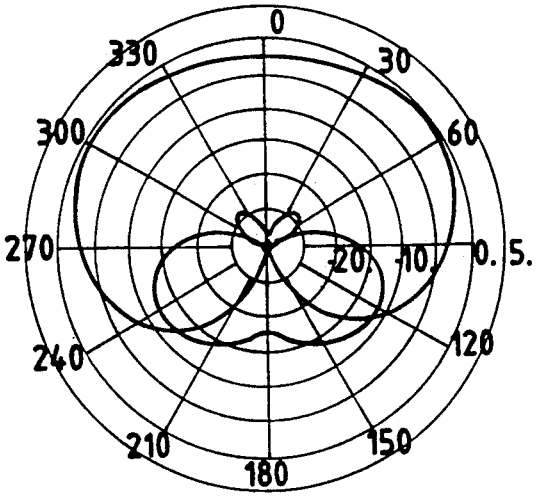

FIG. 7 shows the radiation pattern of the coupled antenna, which differs little from the radiation patterns of the quadrifilar helices taken separately.

This embodiment can obviously be extended to more than two concentric quadrifilar helix, so as to obtain as many distinct passbands as there are distinct helix.

Wideband Antenna

By modifying the parameters of the antennas and the distance between the layers, the electromagnetic coupling between the two overlapping quadrifilar helices makes it possible to obtain a single passband that is wider than with a single-layer helix having the same parameters.

A configuration such as this is obtained, for example, by choosing the values of the parameters of table II.

TABLE II

| | internal helix | external helix |
|---|---|---|
| C | 0.34 λo | 0.46 λo |
| Le | 0.72 λo | 0.75 λo |
| Lax | 0.62 λo | 0.65 λo |

For these values of parameters, the initial passband is 65 Mhz for an SWR<2.5 for the internal antenna and SWR<2 for the external antenna.

In coupled operation, the passband for the dual layer antenna is equal to 86 MHz for an SWR<2. The corresponding SWR pattern and the Smith pattern of the impedance curve are shown in FIGS. 8 and 9.

The SWR is smaller than 1.75 on a continuous frequency band of 1.535 to 1.595 approximately, with a resonance curve of 1.59 Ghz. The impedance curve of FIG. 9 extends for F1=1.5 Ghz to Ff=1.63 Ghz practically integrally in the matching zone of the chart (with the possibility of more precise centering on the chart as for the previous embodiment).

Generally speaking, the structure of the antenna of the invention thus makes it possible to "reduce" the imaginary part of the impedance and bring its real part about 50Ω.

No substantial modifications are observed in the radiation patterns, FIG. 10 representing the pattern for the coupled dual layer antenna.

Owing to these characteristics, and owing to the possibility of the dual frequency, wideband embodiment, the antenna structure of the invention has many fields of application.

Thus it can be applied to satellite communications systems in L band currently being developed, for example those used by the "International Maritime Satellite Organization" (INMARSAT) in the field of worldwide maritime communications.

We can also cite systems in the U.S. such as the "Mobile Satellite System" (MSAT) which is carrying on the development of its own communications service for land-based vehicles. Similarly, different concepts have been proposed for air traffic communications and control (see J. Huang and D. Bell, "L-Band Satellite Communications Antennas for U.S. Coast Boats, Land Vehicles and Aircraft", IEEE, AP-S INT.SYMP. Digest 1987 (AP 22-1).

In Europe, the ESA (European Space Agency) program PROSAT is planning the development, for data transmission (PRODAT), of low G/T (−24 dB/K) terminals for air navigation (elevation between 10° and 90°), sea navigation (elevation between −25° and 90° to take account of +/−30° movements of the ship due to rolling and pitching) and land navigation (elevation between 15° and 90°) wherein the antenna structure of the invention finds advantageous application.

The implementation of the invention is clearly not restricted to these examples of use, and those skilled in the art will themselves be able to conceive of embodiments of the antenna other than those described herein, without going beyond the scope of the invention.

What is claimed is:

1. A resonant helical antenna with quasi-hemispherical radiation comprising at least two concentric quadrifilar helices, each of the quadrifilar helices comprising four wires arranged helically to define a cylinder of constant radius, the radius of each of the quadrifilar helices being unique, and each one of the quadrifilar helices formed of two bifilar helices arranged orthogonally and excited in phase quadrature, the quadrifilar helices being situated coaxially with respect to each other, the wires of the quadrifilar helices being positioned to substantially radially overlap each other for electromagnetically coupling the quadrifilar helices to improve the passband of the antenna.

2. An antenna according to claim 1, wherein the length of the wires forming each of said quadrifilar helices is smaller than the wavelength λ of operation of said antenna.

3. An antenna according to claim 2 wherein the length of the wires is comprised between λ/2 and λ.

4. An antenna according to claim 1 further comprising a common feeder to which said quadrifilar helices are connected in parallel.

5. An antenna according to claim 4, wherein said common feeder includes a coupler element for the excitation, in phase quadrature, of the two orthogonal bifilar helices of each quadrifilar helix and a symmetrizer element for feeding, in phase opposition, each of the wires of the bifilar helices.

6. An antenna according to claim 1, wherein the wires of at least one of the quadrifilar helices are open at their non-excited end.

7. An antenna according to claim 1, wherein the wires of at least one of the quadrifilar helices comprises strips of electrically conductive material printed on a dielectric support.

8. An antenna according to claim 1, wherein the electromagnetic coupling of said quadrifilar helices is controlled through at least one of the following means:

the radial divergence of overlapping of said quadrifilar helices;

the angular offset between said quadrifilar helices;

the pitch of each of said helices.

9. An antenna according to claim 1 wherein the wires of at least one of the quadrifilar helices are short-circuited at their non-excited end.

10. A resonant helical antenna with a quasi-hemispherical radiation pattern comprising:

at least two electromagnetically coupled concentric quadrifilar helices, each of the quadrifilar helices including four wires arranged helically to define a cylinder of unique constant radius, the wires of each of the quadrifilar helices forming two orthogonally arranged bifilar helices which are excited in phase quadrature; and a common feeder connected to the wires of the quadrifilar helices in parallel, wire to wire.

11. A resonant helical antenna a quasi-hemispherical radiation pattern comprising:

at least two electromagnetically coupled concentric quadrifilar helices, each of the quadrifilar helices including four wires arranged helically to define a cylinder of unique constant radius, the wires of each of the quadrifilar helices forming two orthogonally arranged bifilar helices which are excited in phase quadrature; and feeder means for connecting at least one, but less than all, of said quadrifilar helices in parallel wire to wire so that at least one of said quadrifilar helices operates as a stray element with respect to at least one other of said quadrifilar helices.

12. An antenna according to either claim 10 or 11 wherein the wires of said quadrifilar helices are situated in substantially radial overlapping position with respect to each other.

13. An antenna according to any of claims 1, 10 or 11 wherein the length of the wires forming said quadrifilar helices is about 0.75 λ.

14. An antenna according to any of claims 1, 10 or 11 wherein the axial length of the quadrifilar helices is between about 0.58 λ and 0.65 λ.

15. An antenna according to any of claims 1, 10 or 11 wherein the circumference of the quadrifilar helices is between about 0.34 λ and 0.57 λ.

* * * * *